United States Patent [19]

Chetelat et al.

[11] 4,154,053

[45] May 15, 1979

[54] ELECTRONIC TIMEPIECE HAVING AN ADJUSTABLE RATE OF DIVISION AND METHOD FOR ITS MANUFACTURE

[75] Inventors: Fernand Chételat, Cortaillod; Daniel Rochat, Saint-Blaise, both of Switzerland

[73] Assignee: Ebauches S.A., Switzerland

[21] Appl. No.: 789,199

[22] Filed: Apr. 20, 1977

[30] Foreign Application Priority Data

Apr. 23, 1976 [CH] Switzerland ..... 5119/76

[51] Int. Cl.[2] ..... G04C 3/00

[52] U.S. Cl. ..... 58/23 R; 58/74; 58/75; 58/85.5

[58] Field of Search ..... 58/74, 75, 85.5, 23 R, 58/23 C

[56] References Cited

U.S. PATENT DOCUMENTS 3,914,931 10/1975 Tsurishi ..... 58/23 R

*Primary Examiner*—Robert K. Schaefer

*Assistant Examiner*—Leonard W. Pojunas, Jr.

*Attorney, Agent, or Firm*—Silverman, Cass & Singer, Ltd.

[57] ABSTRACT

An internal correction circuit is provided to correct the timepiece error caused by the crystal oscillator frequency changes. The timepiece operates by frequency dividing the oscillator frequency to obtain a predetermined operating frequency. The correction circuit is operated by the user on any initialization point, such as the start of any minute from a reference time source to generate a first input signal. The user at any following minute of the reference time source generates a second input signal.

The correction circuit counts a first and second number of time units of different lengths between the first and second input signals. The circuit then forms a division ratio from the first and second numbers. That ratio is used to change the frequency divider division ratio to adjust the watch for the crystal frequency error just calculated.

8 Claims, 7 Drawing Figures

ELECTRONIC TIMEPIECE HAVING AN ADJUSTABLE RATE OF DIVISION AND METHOD FOR ITS MANUFACTURE

The present invention relates to an electronic timepiece comprising a basis of time, a frequency divider having an adjustable rate of division, a counting and display circuit for the hours indications equipped with a device of correction of the hours indications and of resetting of the hour, a circuit of adjustment of the rate of division of the frequency divider and memories containing the predetermined value of the adjustment to be realised.

In the electronic timepieces, the frequency standard is often constituted by a quartz crystal the frequency of resonance of which must be adjusted very accurately during its manufacture. A variable capacity must also be provided in the oscillator for permitting to correct later the variations of frequency due to the drift of the quartz crystal.

For preventing this expensive adjustment and this variable capacity which is cumbersome, several systems have been suggested, which permit to use quartz crystals, the frequency of which is slightly different from the ideal frequency.

One knows timepieces in which one adjusts the rate of division of the divider of frequency while obliging this divider to come into a determined state, which is different from its state of rest, at the end of each period of counting. Such a circuit is disclosed in the Swiss Pat. No. 558.559. In other timepieces, the rate of division of the divider is itself maintained constant but a supplementary circuit, interposed between the oscillator and the input of the frequency divider, cancels a number of pulses during a determined period of time. Such a circuit is disclosed in the Swiss Pat. No. 534.913.

Whatever the kind of adjusting circuit used may be, this circuit is accompanied with memories, generally realised by means of bistable electronic circuits the outputs of which present the binary information corresponding to the value A of the adjustment to be effected.

Means which do not belong to the timepiece, in some cases combined with inner circuits, permits to put these memories into the desired state. These means, which must comprise a very precise basis of time, are obviously available to the manufacturer, but not obligatory to the watchmakers, and certainly not to the users. If the information contained in the memories has been lost, for instance after a change of battery, or does no longer correspond exactly to the information desired due to the drift of the frequency of the quartz crystal, it is necessary to return the timepiece to the factory, or at least to give it to a specialist equipped with the necessary apparatus.

The purpose of the present invention is to give to the user the possibility of adjusting himself, if necessary, the value of the adjustment contained in the memories, without complicated manipulation and without it being necessary for him to utilize special apparatuses.

The timepiece according to the invention is characterized by the fact that it comprises triggering means of a process of correction of the value of the adjustment, a counter permitting the measure of the time lapsed between two actions on the triggering means, means permitting to measure the difference between, on the one hand, the time counted by the timepiece between the two actions on the triggering means and, on the other hand, the actual time which has lapsed between these two actions, and a circuit of calculation permitting to calculate the correction that the predetermined value of the lapsed time and the means of measure of the difference.

The invention has also for object a method of putting into action this timepiece, which is characterized by the fact that the triggering means is operated a first time for starting the process of calculation and of correction of the value of the adjustment and a second time for terminating this process, the two actions taking place at times which are separated with several hours, but which are both situated in the beginning of a minute of the reference time indicated by a hour signal.

The drawing shows, by way of example, several embodiments of the object of the invention and illustrates the utilisation according to the invention.

In all the figures, the simple connections, corresponding practically to a unique conductor, are symbolized by single lines, while the multiple connections, corresponding practically to a set of conductors, are symbolized by double lines. The arrows indicate the sense of displacement of the information.

Figure 1:
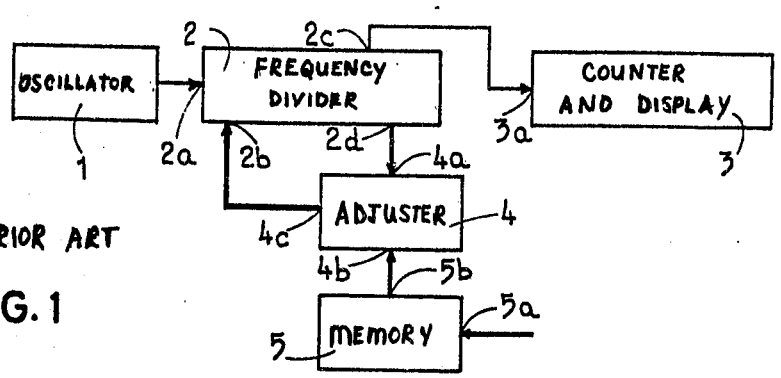
PRIOR ART FIG. 1
FIG. 1 is a simplified diagrammatic representation of a known timepiece having adjusting means of the rate of division of its frequency divider.

FIG. 1 shows the diagram of a known timepiece, comprising an oscillator 1 used as a basis of time. This oscillator is generally a quartz oscillator. It delivers pulses, at a relatively high frequency, at the input 2*a* of a circuit of division of frequency 2. This divider has an output 2*c* which delivers pulses at relatively low frequency of, for instance, 1 Hz, at the input 3*a* of a counting and display circuit of the hour indications 3. This circuit 3 comprises the counters and the conventional displays of the seconds, of minutes and of hours as well as, may be, of date, of the day of the week and of the month. It comprises also known means of correction of the hour indications used, for instance, during a change of battery or during the passage from one time-zone to another one. It is moreover equipped with a setting device used when the hours indicated by the timepiece differs of less than 30 seconds from the exact time, which operates by setting to zero of the seconds counter, with eventual advance of one unity of the counter of the minutes, under the influence of means provided to this effect, operated in concordance with an hour signal indicating the beginning of one minute, such as disclosed in the Swiss patent application No. 263/76 filed by the firm EBAUCHES S.A. on Jan. 12, 1976.

The frequency dividing circuit 2 has, moreover, an output 2*d* which delivers, at the input 4*a* of an adjusting circuit 4, a certain number of information concerning the period of adjustment. It has also a second input, 2*b*, which receives from the output 4*c* of the circuit 4 the adjusting information.

The adjusting circuit 4 receives, by its input 4*b*, the information concerning the value of the adjustment to be realised, information available at the output 5*b* of a memory circuit 5. The inputs 5*a* of this circuit serve to the introduction, by an outer means which has not been represented, of the desired information.

All these circuits are known, their description appearing, for instance, in the above mentioned publications. Consequently, they will not be disclosed here more in detail.

Figure 2:
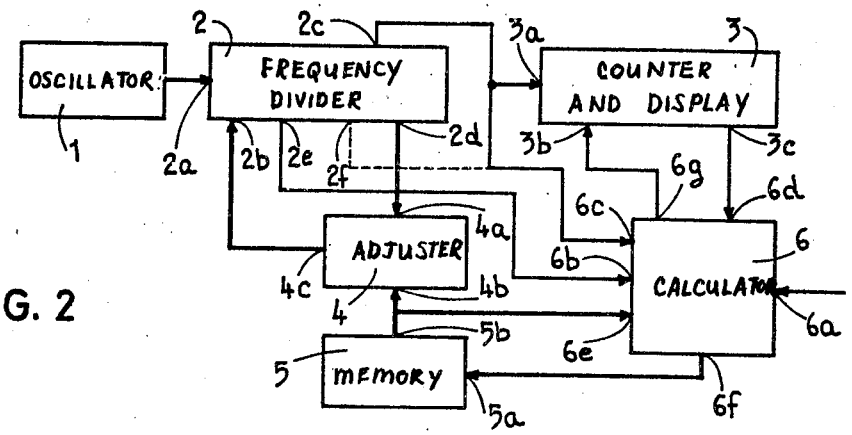
FIG. 2 is a simplified diagram of the timepiece according to the invention.

FIG. 2 shows an example of diagram of the present timepiece comprising, as this one of FIG. 1, an oscillator 1, a circuit of division of frequency 2, a counting and display circuit 3, with its setting device, an adjusting circuit 4 of the rate of division of the frequency dividing circuit, and memories 5. These circuits are interconnected and operate as these of FIG. 1.

This timepiece comprises, moreover, a calculation circuit 6 which has a triggering input 6*a*, an input 6*b* receiving a signal of relatively high frequency from an output 2*e* of the frequency divider 2, an input 6*c* receiving the signal of frequency of 1 Hz delivered by the output 2*c* of the divider 2, an input 6*d* receiving a signal at the frequency of one pulse per hour delivered by the output 3*c* of the counting and display circuit 3, an input 6*e* receiving the information conserved in the memory 5, an output 6*f* connected to the input 5*a* of the memory 5 and on which the information concerning the value of the adjustment is available at the end of the process of calculation which will be disclosed hereafter, and an output 6*g*, connected to an input 3*b* of the display circuit 3.

Figure 3:
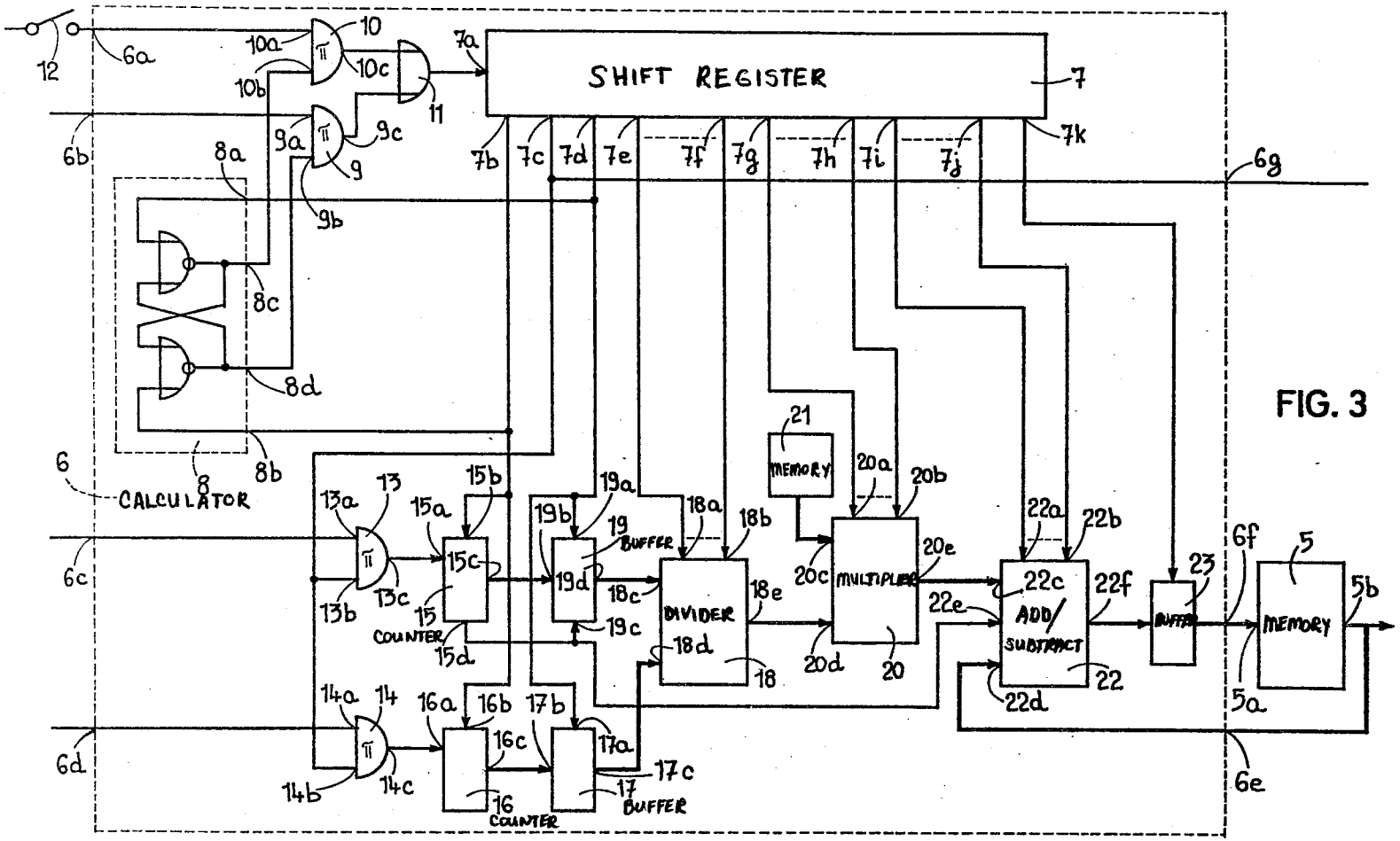
FIG. 3 is a simplified diagram of one embodiment of the calculation circuit of the diagram of FIG. 2.

One of the possible embodiments of the calculation circuit 6 is diagrammatically represented in FIG. 3.

In this embodiment, the calculation circuit 6 comprises a shifting register 7 realised in such a way that, at each time, only one of its outputs 7*b* to 7*k* is at the logic state 1. All its other outputs are at the logic state 0. This shifting register 7 has an input 7*a* to which are applied pulses as it will be disclosed later. Each time a pulse is applied to the input 7*a*, the output which was, immediately before, at the logic state 1, passes to the logic state 0; at the same time, the output of the immediately upper range, which was at the state 0, passes to the state 1. When the last output 7*k* is at the state 1 and if a new pulse is applied to the input 7*a*, the output 7*k* passes to the state 0 and the first output 7*b* passes to the state 1. It will be indicated later that, in normal time, it is this output 7*b* which is at the logic state 1.

This output 7*b* is connected to the input 8*b* of a bistable circuit 8 composed, conventionally, of two NOR gates interconnected. In normal time, the logic state 1 which is present on this input produces a logic state 0 on the output 8*d*. This state 0 is applied to the input 9*b* of an AND gate 9, that gives to its output 9*c* also a state 0. The output 7*d* of the register 7, connected to the input 8*a* of the bistable 8, being to the state 0, as well as the output 8*d*, the output 8*c* is in the logic state 1. This state being applied to the input 10*b* of an AND gate 10, this latter is in condition for transmitting at its output 10*c* any signal 1 which would be applied to its other input 10*a*. The output 10*c* of this gate 10 is connected, by the intermediary of an OR gate 11, to the input 7*a* of the register 7.

When the user acts a first time on a control pusher 12, symbolised by a contact in FIG. 3, in concordance with an hour signal transmitted by the broadcasting, the telephone or any other means, and indicating the beginning of a whole minute, a logic signal 1 is applied to the input 6*a* of the calculation circuit 6 by the intermediary of adaptation circuits which have not been represented and, from this point on, to the input 7*a* of the register 7 through the AND gate 10 and OR door 11. This signal has for effect to bring the output 7*b* of the register 7 to pass to the state 0 and the output 7*c* to the state 1.

This logic state 1 is applied to the inputs 13*b*, 14*b* of the AND gates 13 and 14, respectively, that lets pass at their outputs 13*c*, 14*c*, the signals which are present at the inputs 13*a* and 14*a*, respectively.

The signal present at the input 13*a* is furnished by the output 2*c* of the frequency divider 2 (FIG. 2). It is composed of pulses the frequency of repetition of which is of 1 Hz, with the precision that results from the whole oscillator 1—frequency divider 2. This precision is, obviously, not absolute. These pulses are applied, through the AND gate 13, at the input 15*a* of a binary counter 15. This counter is arranged in such a way that its outputs 15*c* present successively the binary combinations corresponding to the decimal numbers 0 to 59. When these outputs 15*c* present the binary combination corresponding to the decimal number 59, the next pulse, applied to the input 15*a*, produces the passage of the outputs into a binary state corresponding to 0. The counter 15 is consequently a counter modulo 60. It contains permanently in binary the number of seconds, modulo 60, which have lapsed from the time of the first action on the pusher 12. The counter 15 has another output, 15*d*, which presents a first logic state, for instance 0, when the outputs 15*c* are in the states corresponding to the numbers 0 to 29, and a second logic state, for instance 1, when they are in the conditions corresponding to the numbers 30 to 59.

The signal present at the input 14*a* of the gate 14 is furnished by the output 3*c* of the counter 3 (FIG. 2). It is composed of pulses having a frequency of 1 per hour. These pulses are applied at the inputs 16*a* of a binary counter 16. The outputs 16*c* of this counter 16 presents the binary combinations corresponding to the number of hours which have lapsed from the time of the first action on the pusher 12.

The signal 1 present on the output 7*c* of the register 7 is also brought, by the output 6*g* of the calculation circuit 6, to the input 3*b* of the counting and display circuit 3. In this circuit, means not disclosed are provided for operating, in response to this signal 1, a portion of the display, so as to recall to the user that he has acted on the triggering pusher 12 and that the process of correction is proceeding.

When the user acts a second time on the pusher 12, again in concordance with a hour signal transmitted by the broadcasting, the telephone or other, and indicating the beginning of a whole minute, a logic state 1 is anew applied to the input 7*a* of the register 7, by the input 6*a* of the calculation circuit and through the AND gate 10 and OR gate 11. This signal makes the output 7*c* of the register 7 to pass to the state 0 and the output 7*d* to the state 1. The signal 0 of the output 7*c* closes again the AND gates 13 and 14, locking the counters 15 and 16. At this moment, the counter 16 contains the number of hours H which have lapsed from the time of the first action on the pusher 12, and the counter 15 a number N which is the number of seconds, modulo 60, counted by the timepiece, also from the time of the first action on the pusher 12.

While assuming, and this is reasonable, that the timepiece has not drifted more than 30 seconds, more or less, between these two actions, if this number N is comprised between 0 and 29, that means that the timepiece is fast and N represents exactly the number S of seconds of gain: N=S. If, on the contrary, N is comprised between 30 and 59, that means that the timepiece is slow, and N represents then the complement to 60 of the number S of seconds of loss: S=60-N.

The signal 1 on the output 7d of the register 7, which is also applied to the input 17a of the circuit 17, produces the passage of the content of the counter 16 to the input 18d of a binary dividing circuit 18. The same signal 1 is also applied to the input 19a of a circuit 19 and it produces the passage of the content of the counter 15 to the input 18c of the binary dividing circuit 18, providing the signal present at the input 19c coming from the output 15d of the counter 15 is in the state corresponding to a gain of the timepiece; if this signal is in the state corresponding to a loss, it is the complement to 60 of the signal present at the input 19b which is transmitted to the output 19d and, from this point on, to the input 18c of the binary divider 18.

The same signal 1 present at the output 7d of the register 7 produces the resetting of the bistable circuit 8. The output 8c passes consequently to the state 0, locking the AND gate 10. The output 8d passes to the state 1, which is applied at the input 9b of the AND gate 9. The signal present at the input 9a of this door 9 can consequently reach the output 9c, and, from this point on, through the OR gate 11, the input 7a of the register 7. This signal present on the input 9a of the door 9 is composed of pulses which succeed themselves at a relatively high frequency, produced by the output 2e of the frequency divider 2. One sees consequently that, from this time on, the control pusher 12 is made inactive and that the register 7 receives pulses which make it advance at a relatively high rate. The outputs 7e to 7k will consequently pass successively to the state 1, without any intervention of the user.

The dividing circuit 18 is arranged in such a way as to furnish at its output 18e the quotient E of the binary numbers S and H present at its inputs 18c and 18d. It is of any type. In these binary dividing circuits, the division is generally made in several elementary successive operations.

For instance, when the first input 18a of the divider 18, which is connected to the output 7e of the register 7, is in the logic state 1, the first elementary operation is effected. The following operations are executed when the next inputs, not represented, are put to the state 1 by the corresponding outputs, also not represented, of the register 7. The last partial operation is effected when the last input 18b, connected to the output 7f of the register 7, is at its turn at the state 1. The quotient E is then available on the outputs 18e of the divider 18.

This quotient E represents the running of the timepiece, expressed in seconds by hour. For obtaining the number to be furnished to the adjusting circuit of the rate of division of the frequency divider 2, it is necessary still to multiply E by a constant factor K which depends from the system of adjustment used and which has the value:

$$K=(fo\cdot Tc/3600)$$

where fo is the frequency of the signal to be corrected and Tc the period of correction.

For realising this multiplication, a binary multiplicating circuit 20 is provided, which is arranged in such a way as to furnish at its outputs 20e the product of the numbers K and E present at its inputs 20c, respectively 20d. As hereabove indicated, for a type of given circuit of correction, the number K is constant. The memory 21, which contains it, can consequently be a read only memory.

The binary multiplicating circuit 20 can be of any type. As for the operation of division hereabove disclosed, the multiplication is made in several elementary operations, the first of which is realised during the output 7g of the register 7, connected to the input 20a of the multiplicator 20, is in the state 1 and the last during the output 7h of the register 7, connected to the input 20b of the multiplicator 20, is at its turn at the state 1. At this time, the product P+K·E is present at the outputs 20e of the multiplicator. This product represents the number it is necessary to add to or to substract from the number lying in the memory 5 so that the adjusting circuit 4 corrects the rate of division of the frequency divider 2, in such a way that the frequency of the signal furnished by the frequency divider at its output 2c be exactly the desired frequency, for instance 1 Hz.

This last operation is realised by an adding-subtracting circuit 22, which receives on its inputs 22c the number P, on its inputs 22d the number A, lying then in the memory 5, and on its input 22e the signal coming from the output 15d of the counter 15 and indicating if the timepiece is going fast or slow. The kind of operation to be effected (addition or substraction) depends from the type of adjusting circuit used in the timepiece: for an adjusting circuit operating by suppression of pulses, it will be necessary to add P to the content of the memory if the timepiece is going fast and to subtract it if it goes slow. On the contrary, for an adjusting circuit using the putting into a preselected state of the frequency divider, it will be necessary to subtract P from A if the timepiece is going fast and to add it if is goes slow.

The adding-subtracting circuit 22 can be of any type. As the dividing circuits 18 and multiplicating circuit 20, it effects generally the additions or the subtractions in several successive operations realised when the inputs 22a to 22b, connected to the outputs 7i to 7j of the register 7 receive logic signals 1. After the last partial operation, realised when it is the input 22b which is in the state 1, the result is present at the outputs 22f. The circuit 23 transmits this result to the inputs 5a of the memory 5 when the output 7k of the register 7 is, at its turn, in the state 1.

As hereabove disclosed, the next pulse, delivered at the input 7a of the register 7, brings again the output 7k to the state 0 and the output 7b to the state 1. This signal 1 applied at the input 8b of the bistable 8 brings its output 8d to the state 0 and its output 8c to the state 1. The pulses arriving at the input 9a of the AND gate 9 are then locked and the register 7, which does no longer receive pulses on its input 7a, has its output 7b which remains at the state 1.

The AND gate 10 is anew in condition for letting pass the signal 1 which will arrive at its input 10a the next time the user operates the triggering pusher 12.

Simultaneously, the signal 1 present at the output 7b of the register 7 is applied to the inputs 15b and 16b of the counters 15 and 16, that brings them again into the conditions corresponding to the number 0.

It is obvious that the calculation circuit 6 hereabove disclosed is only one of the numerous circuits which can be conceived. Especially, the dividing circuits 18 and multiplicating circuits 20 can be realised with the same physical elements, and not separated as they are in the diagram of FIG. 3. In this case, it would be necessary, obviously, that the rest of the diagram be reorganised accordingly.

On the other hand, the succession of the operations can be different from this one which is disclosed. Especially, one could easily conceive a calculation circuit where the number N would be multiplied by the constant K before the division by the number H takes place. While choosing suitably the parameters of the adjusting circuit, one can even arrive to suppress this operation of multiplication. To this effect, it is sufficient to choose a period of correction Tc suitable and to connect the input 6c of the calculation circuit not to the output 2c of the frequency dividing circuit furnishing pulses of a frequency of 1 Hz, but to another output 2f furnishing pulses of a frequency of K Hz,, as indicated in dotted lines on FIG. 2. The counter 15 must obviously be transformed for becoming a binary counter modulo K·60.

While proceeding this way, the number which lies in the counter 15 after the second action on the control pusher 12 will be directly K·N. Likely, if this number is situated between 0 and K·30−1, this will mean that the timepiece goes fast, while, if it is situated between K·30 and K·60−1, the timepiece goes slow. In this last case, it is the complement to K·60 which must be transmitted to the input 18c of the binary divider 18. A numerical example is given hereafter for illustrating this possibility:

In a known system, the frequency fo has been fixed at 16385 Hz and the period of correction to 32 seconds. It results therefrom that the factor of multiplication K has the value:

$$K=(16384\cdot 32/3600)=145{,}635$$

If, on the contrary, one chooses, always for a frequency fo of 16384 Hz, a period of correction of 28,125 seconds, one finds a factor K the value of which is:

$$K=(16384\cdot 28{,}125/3600)=128$$

This value of K being a whole power of 2, it will be sufficient to connect the input 6c of the calculation circuit to the output of the stage of division of frequency giving the frequency of 128 Hz. The counter 15 will then contain, at the time of the second action on the pusher 12, the value 128·N, and the circuit of multiplication 20 can be eliminated. In this case, the output 18e of the dividing circuit 18 will be connected directly to the input 22c of the adding-subtracting circuit 22.

Figure 4:
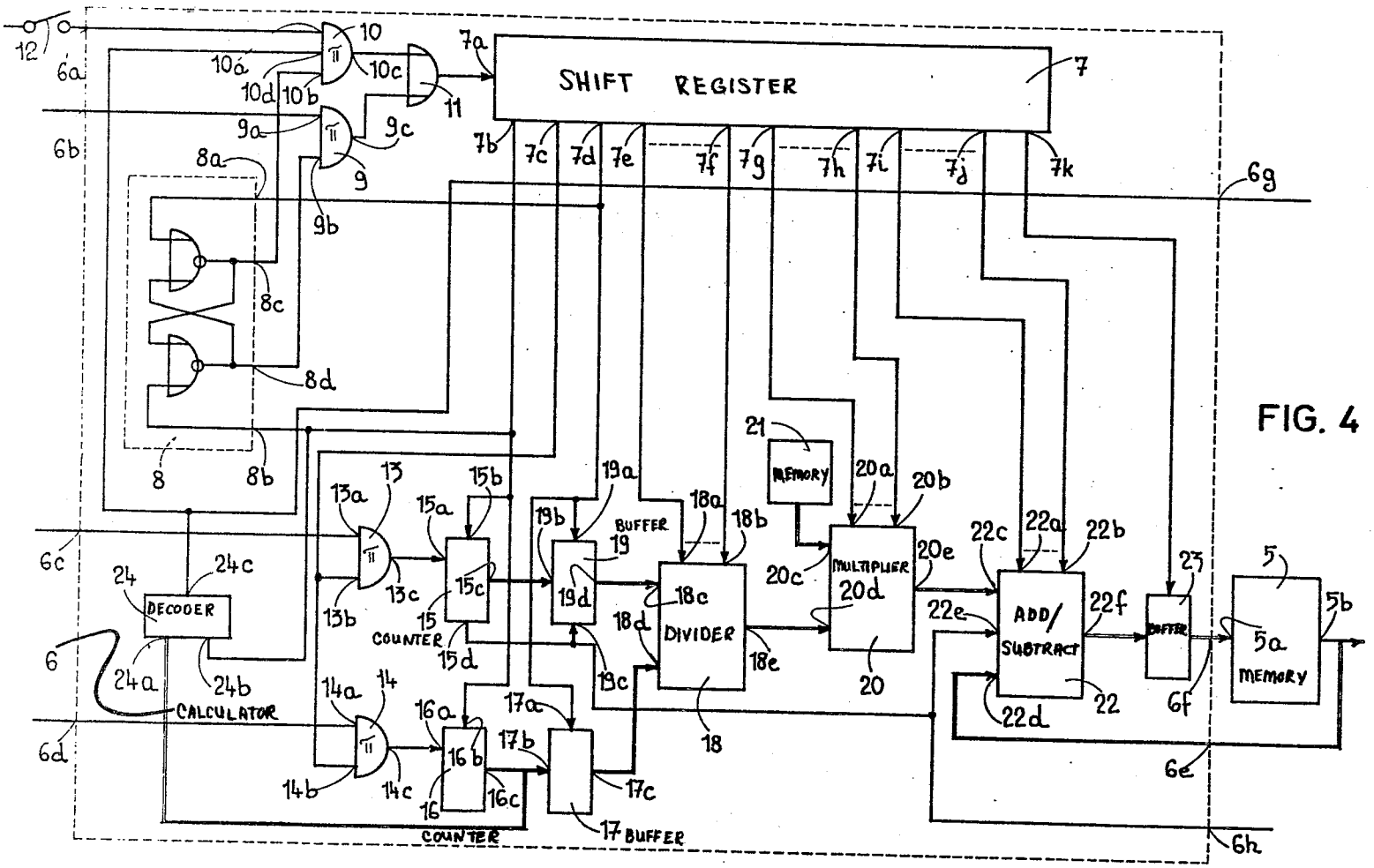
FIG. 4 is a diagram of a modification.

In the embodiment hereabove disclosed in reference to FIG. 3, the time between the two actions on the control pusher 12 is not specified. Now, the precision of the calculation increases with this time; it is consequently advantageous to fix a minimum time under which a new pressure on the trigger means has no effect. This purpose can be reached while modifying the calculation circuit 6 in the way indicated in FIG. 4. This last figure shows a decoder 24 the inputs 24a of which are connected to the output 16c of the counter 16 and the input 24b of which to the output 7b of the register 7. The output 24c of the decoder is connected to a third input, 10d, of the AND gate 10 and to the output 6g of the calculation circuit, which consequently is no longer connected to the output 7c of the register 7.

This decoder 24 is arranged in such a way that its output is at the logic state 1 when its inputs are in the state corresponding to a decimal number greater than a determined number, 16 for instance, or when the output 7b of the register 7 is in the state 1, and in the state 0 in all the other cases. Consequently it can merely consist in an OR gate the inputs of which are connected to the outputs of weight equal to 16 or higher than 16 of the counter 16, another input being connected to the output 7b of the register 7. Thus, the AND gate 10 is open so long the user has not operated a first time the control pusher 12. After this first action, the input 10d of the gate 10 passes to the state 0, locking the gate and making unoperable any new action of the control pusher 12. It is only when the counter 16 will have counted, in the present example 16 hours, that the input 10d will pass again to 1, permitting thus to the signal produced by the pusher 12 to act on the register 7. At the same time, the signal 1 sent by the output 6g to the display circuit 3 will activate the display element provided to this effect, indicating thus to the user that he can act on the pusher 12 to end the correcting process. The rest of the operations of calculation and of correction are identical to what has been disclosed hereabove.

Figure 5:
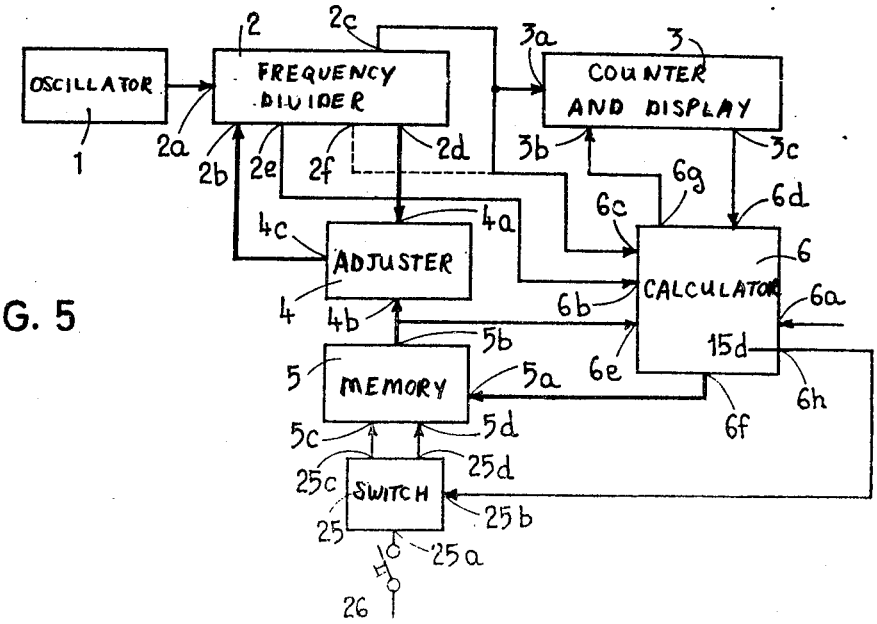
FIG. 5 is the diagram of a watch realised according one of the embodiments of the preceeding figures.

FIG. 5 shows the diagram of a watch realised according one of the embodiments hereabove disclosed, but where the memory 5 containing the information relating to the adjustment of the frequency of the oscillator is a reversible counter with preselection. This counter can be put in a determined condition by its inputs 5a, as the memory used in the embodiments disclosed hereabove. It has moreover two counting inputs 5c and 5d. The pulses applied to the input 5c produce an increase of the content of the memory, these which are applied to the input 5d producing a decrease of this content. This circuit being known, it will not be disclosed here more in detail.

The inputs 5c and 5d are connected to the outputs 25c, respectively 25d, of a switching circuit 25 which receives on its input 25a signals coming from a triggering pusher 26 symbolized by a contact. These signals are directed on the output 25c or on the output 25d according to the state of another input 25b which receives, by the intermediary of the output 6h of the circuit of calculation 6, the signal present at the output 15d of the counter 15. As it has been indicated hereabove, the state of this output 15d permits to determine, at the moment of an hour top, whether the watch is going fast or slow. It is thus possible, while acting on the pusher 26, to correct step by step the content of the memory 5 and, consequently, the running of the watch. This circuit 25 is disclosed in detail in the Swiss patent Application No. 5.120/76, filed at the same time as the present invention in Switzerland.

The advantage of the adjunction of the circuit 25 lies in the fact that this latter permits the correct rapidly, if not very exactly, the important errors which can occur, for instance at the opportunity of a change of the battery feeding the watch.

Figure 6:
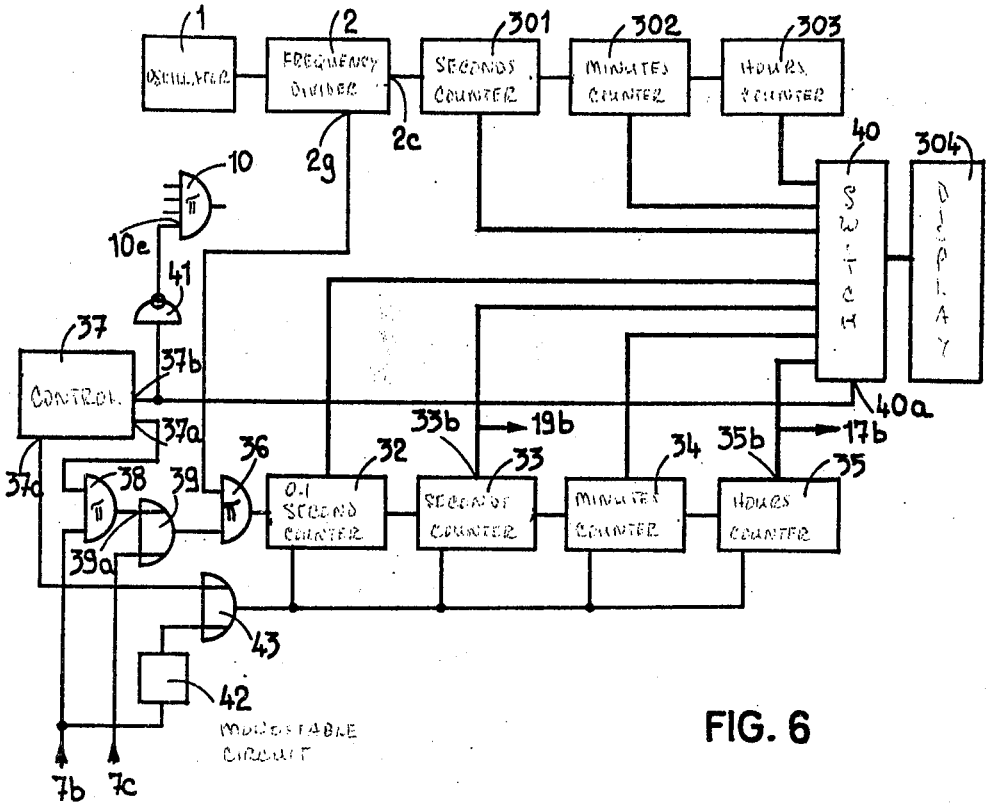
FIG. 6 is a diagram of a chronograph-watch.

Some watches are equipped with supplementary counters and with means for triggering and untriggering them and for displaying their content. It is the matter, especially, of the chronograph-watches and of the watches equipped with special counters for some sports. FIG. 6 shows the diagram of such a chronograph-watch comprising, as the watch of FIG. 3, an oscillator 1 and a frequency divider 2, the output 2c of which delivers pulses of 1 Hz to the seconds counters 301, followed by the minutes counters 302, the hours counters 303, etc. A supplementary output 2*g* of the divider 2 delivers pulses at a frequency higher than 1 Hz, for instance 10 Hz, or even 100 Hz, to the circuit of chronograph. In the example of FIG. 6, this frequency is of 10 Hz and the circuit of chronograph is composed of a counter of the tenths of seconds 32, of the seconds 33, of the minutes 34 and of the hours 35. The output 2*g* of the divider 2 is connected to the input of the counter 32 by the intermediary of an AND gate 36 the second input of which receives a signal from the output 37*a* of the control circuit of the function of chronograph 37, not disclosed, through the AND gate 38 and the OR gate 39. The output signals of the counters 32 to 35, as well as these of the counters 301 to 303, are brought to the inputs of a switcher 40 the role of which is to direct either the ones or the others to the display 304, in function of a signal delivered at its input 40*a* by an output 37*b* of the control circuit 37. This signal is in a determined logic state, for instance 0, when the function of chronograph is not selected, and in the other logic state, for example 1, in the contrary case. All the circuits used for this function of chronograph being known, they will not be disclosed here in detail.

In the present watch, the second input of the AND gate 38 is connected to the output 7*b* of the register 7, and the second input of the OR gate 39 to the output 7*c* of the same register 7. Moreover, the outputs 33*b* of the counter of seconds 33 are connected to the inputs 19*b* of the circuit of transmission 19, the outputs 35*b* of the counter of the hours 35 being connected to the inputs 17*b* of the circuit of transmission 17. Thus, in normal time, the function of chronograph can be used without restriction, the output 7*b* of the register 7 being at 1, that opens the AND gate 38. When this function of chronograph is selected, the signal 1 which is present at the output 37*b* of the circuit 37 is sent, by the intermediary of an inverter 41, to another input 10*e* of the AND gate 10, for locking it and preventing the untriggering of the process of correction. If, on the contrary, the function of chronograph is not triggered, after the first action on the control pusher 12, this AND gate 38 is locked by the signal 0 which appears at the output 7*b* of the register 7. At the same time, the signal 1 which is delivered by the output 7*c* of the register 7 is applied to the AND gate 36 by the intermediary of the OR gate 39. The pulses delivered by the output 2*g* of the divider 2 arrive then up to the counter 32. The counters 33, 34 and 35 receive also pulses at period of time dictated by the preceeding stages. When the user acts a second time on the pusher 12, the AND gate 36 is locked again, and the counters 32 to 35 remain in their state. The content of the counters 33 and 35 is then treated by the circuit of calculation 6 as were the contents of the counters 15 and 16 in the case represented in FIG. 3. At the end of the process of correction, when the output 7*b* of the register 7 comes again to the state 1, a signal of resetting to zero of the counters 32 to 35 is delivered by the monostable circuit 42 through the OR gate 43. The other input of this latter receives the signal of resetting to zero delivered by the output 37*c* of the control circuit 37 of the function of chronograph.

It is to be noted that, so long as the process of correction is in course, the function of chronograph cannot be used. The display produced by the signal present in this case at the input 3*b* of the display circuit recalls to the user that the process of correction is in course and that he cannot, consequently, use the chronograph.

Figure 7:
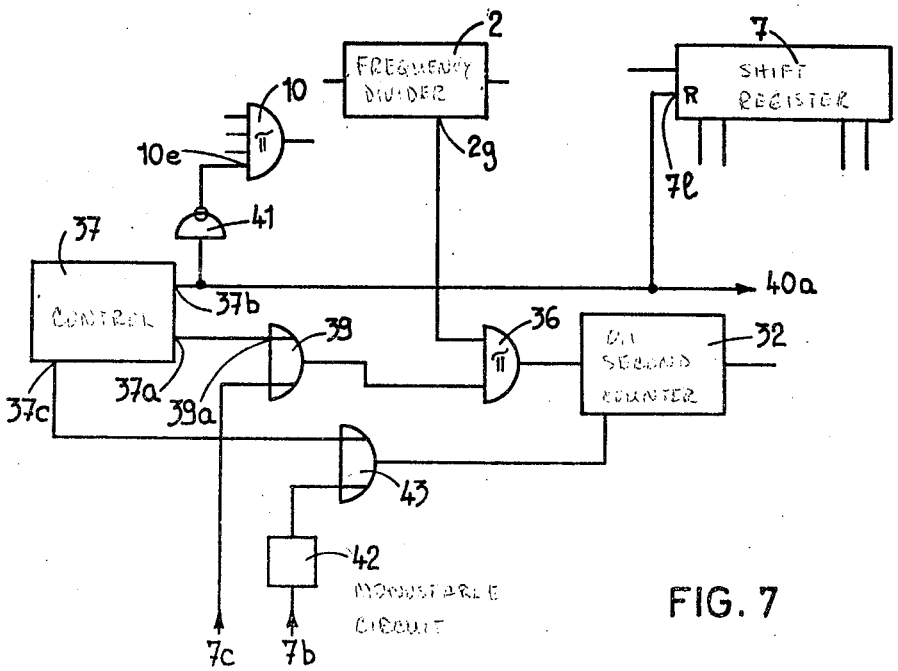
FIG. 7 is the diagram of a modification of a chronograph-watch.

In another embodiment of the present watch, represented in FIG. 7, the output 37*b* of the control circuit 37 is connected to an input 7*l* of resetting to zero of the register 7. The output 37*a* of the same circuit 37 is connected directly to the input 39*a* of the OR gate 39. In this case, the function of chronograph can be selected at any time. If it is selected after the process of correction has been triggered, this latter is interrupted, and the register 7 is put again into its rest position. Its output 7*b* comes consequently again into the state 1, that produces the resetting to zero of the counters 32 to 35, by the intermediary of the monostable circuit 42 and of the OR gate 43.

The resetting device of the display and counting circuit 3 must be operated, as the circuit of calculation 6, in the beginning of a minute indicated by an hour signal transmitted by the broadcasting, the telephone or other. It is consequently advantageous to provide the same means for operating this two circuits. Thus the user, when he ascertains that his watch does no longer indicate the exact hour, will have only one manipulation to carry out for resetting it to the hour and, at the same time, for correcting its running.

This means can be constituted, as in the specification hereabove, by a mere pusher operating a contact connected to a circuit of elimination of the effect of the reboundings. But it can also be constituted by a detector of proximity, capacitive or other, reacting, for instance, at the presence of the finger of the user, or by a photoelectric device, or by any other device delivering an electric signal when it is operated.

What we claim is:

1. In an electronic timepiece including oscillator means for producing a high frequency signal, frequency divider means coupled to said oscillator means for dividing said high frequency signal into at least two low frequency signals according to a division ratio which is adjustable, first counter means coupled to said frequency divider means for counting the periods of one of said low frequency signals and generating time unit signals therefrom, display means coupled to the first counter means adapted to display time information from one of the time unit signals, adjustment means coupled to said frequency divider means for adjusting said division ratio, memory means coupled to said adjustment means adapted to store signals representative of said value of said division ratio, and input means for producing input data signals, the improvement comprising:

second counter means coupled to said first counter means and said input means for counting the number H of periods of one of said time unit signals occurring between two consecutive input data signals;

third counter means coupled to said frequency divider means and said input means for counting the number S of periods of one of said low frequency signals occurring between said two consecutive input data signals; and calculating means coupled to said second counter means, said third counter and said memory means for computing said value of said division ratio from said numbers H and S, and for introducing said computed value into said memory means.

2. The electronic timepiece of claim 1, wherein said third counter means is a binary counter modulo K·60 where K is a constant integer equal to $2^n$ with $n \geqq 0$, and said low frequency signal whose periods are counted by said third counter have a frequency of $2^n$ Hz.

3. The electronic timepiece of claim 1, wherein said second counter means is a binary counter and said one of said time unit signals is an hour signal.

4. The electronic timepiece of claim 1, wherein said second and third counter means are binary counters, and wherein said calculating means comprises a binary divider adapted to calculate a number C by dividing said number S by said number H and a binary multiplier adapted to multiply said number C by a constant number.

5. The electronic timepiece of claim 1, wherein said display means comprises a display element responsive to said input data signals to give a visual indication during the time separating said two consecutive input data signals.

6. The electronic timepiece of claim 1, further comprising time setting means coupled to said first counter means and to said input means, and responsive to said input data signals for setting said time information.

7. The electronic timepiece of claim 1, further comprising locking means coupled to said second counter means and to said input means and responsive to said input data signals to prevent the occurrence of the second of the said two consecutive input data signals as long as said number H is not greater than a predetermined number.

8. The electronic timepiece of claim 1, further comprising chronograph circuit means having chronograph input means for producing chronograph input data signals and coupled to selection circuit means, said chronograph circuit means being responsive to said chronograph input data signals for counting the periods of one of said low frequency signals and for delivering chronographed time unit signals, said selection circuit means, also coupled to said display means, being responsive to said chronograph input data signals for applying said chronographed time unit signals to said display means, and logic circuit means coupled on the one hand to said chronograph input means and on the other hand to said second and third counter means, and which is responsive to said chronograph input data signals for connecting said second and third counter means as a part of said chronograph circuit means.

* * * * *